US005962979A

United States Patent [19]

Dejonge

[11] Patent Number: 5,962,979

[45] Date of Patent: Oct. 5, 1999

[54] ASYMMETRICAL BUS CAPACITORS

[75] Inventor: Stuart W. Dejonge, Riegelsville, Pa.

[73] Assignee: Lutron Electronics Co., Inc., Coopersburg, Pa.

[21] Appl. No.: 09/139,173

[22] Filed: Aug. 24, 1998

[51] Int. Cl.[6] ..... H01J 7/44

[52] U.S. Cl. ..... 315/71; 315/58; 315/208; 361/760; 361/522

[58] Field of Search ..... 315/58, 71, 208, 315/275; 361/760, 761, 522, 541; 363/59, 60

[56] References Cited

U.S. PATENT DOCUMENTS 3,781,593 12/1973 Rodriguez ..... 315/58
4,079,292 3/1978 Kaneda ..... 315/289
4,360,762 11/1982 Yamamoto et al. ..... 315/101
4,455,538 6/1984 Kinzler ..... 333/167
4,942,501 7/1990 MacFarlane et al. ..... 361/523

*Primary Examiner*—Haissa Philogene
*Attorney, Agent, or Firm*—Seidel, Gonda, Lavorgna & Monaco, PC

[57] ABSTRACT

A capacitor network includes a plurality of capacitors in series. Each capacitor has a preselected capacitance and breakdown voltage. The sum of the breakdown voltages of all the capacitors is at least equal to a desired voltage value. The capacitances of the capacitors are chosen to provide a desired capacitance value when connected in series. At least one capacitor has a break-down voltage equal to greater than fifty percent of the desired voltage value and a capacitance approximately equal to the desired capacitance value.

12 Claims, 1 Drawing Sheet

ASYMMETRICAL BUS CAPACITORS

FIELD OF THE INVENTION

The present invention relates to capacitor networks comprising a plurality of capacitors arranged in series to achieve a desired voltage rating and capacitance value.

BACKGROUND OF THE INVENTION

The present invention is especially useful in electronic ballast circuits for lighting applications, but is also useful in other electronic circuits where space and cost savings are desired. Although the invention will be described in connection with electronic ballast circuits for lighting applications, it is applicable to other electrical and electronic circuits as well.

In an electronic ballast which has an energy storage device, capacitors are often used to hold a charge. In many electronic ballasts, a dc bus voltage is created in order to efficiently drive the lamps. The bus voltage must be greater than the peak voltage of the input line in order for the power factor correction boost converter to work properly. For any input line, the peak voltage is the product of the nominal input line voltage and the square root of two (which is approximately 1.414). For a standard 120 Vac input line, which is a common household voltage, the peak voltage of the line is approximately 170 V. A typical dc bus voltage is 230 Vdc. The capacitors that support this voltage must therefore be rated for at least 230 Vdc. Capacitors are normally chosen so that the voltage across them is between 65% and 95% of their rated voltage. This range of values is recommended by the capacitor manufacturer. If the capacitor continually sees voltages above this range (i.e., voltages above 95% of rated voltage), the life of the capacitor is reduced. If the capacitor continually sees voltages below this range (i. e., voltages below 65% of rated voltage), the dielectric of the capacitor reforms and the capacitor's maximum voltage rating is decreased to the lower voltage value.

In the previous example, typically two 160 Vdc-rated or two 200 Vdc-rated capacitors, giving a total rating of 320 Vdc or 400 Vdc, would be connected in series to provide a safety margin above 230 Vdc.

For 200 Vac, 220 Vac, and 240 Vac lines, which are common voltages in Asia and Europe, the peak of the line is about 340 V. A typical bus voltage is around 410 Vdc. The capacitors that support this voltage are generally rated for 450 Vdc, so that either a single 450 Vdc or two 250 Vdc capacitors in series are used.

For a 277 Vac line, which is a common voltage in industrial and commercial buildings in the United States, the peak of the line is approximately 400 V, and a typical bus voltage is around 450 Vdc. In order to achieve some safety margin, a capacitor with a total voltage rating of at least 500 Vdc is required. Capacitors with a voltage rating in excess of 450 Vdc are expensive, take up a lot of space, and are difficult to obtain.

In the field of electronic ballasts, and indeed in many other fields, physical size and total cost are important, if not the main, design considerations. In order to provide a capacitor for a 500 Vdc bus, design engineers typically would use two 250 Vdc capacitors in series. Capacitors with voltage ratings of 250 Vdc or greater often must be inserted into printed circuit boards by hand, on their side, and then secured to the printed circuit board with either tape, adhesive, or ties. The capacitor leads extend outwardly from the end of the capacitors, and must be bent at a right angle in order to be connected to the printed circuit board. This adds to increased manufacturing and assembly costs, decreased reliability, and adds to the area the capacitors take up on the printed circuit board.

SUMMARY OF THE INVENTION

The present invention uses two capacitors of different voltage ratings in series, e.g., one 450 Vdc capacitor in series with one 50 Vdc capacitor, instead of two capacitors of the same voltage rating in series, e.g., two 250 Vdc capacitors.

The present invention is directed to a capacitor network comprising a plurality of capacitors in series, each capacitor having a preselected capacitance and breakdown voltage. The sum of the breakdown voltages of all the capacitors is at least equal to a desired voltage value. The capacitances of the capacitors are chosen to provide a desired capacitance value when connected in series. At least one capacitor has a breakdown voltage equal to greater than fifty percent of the desired voltage value and a capacitance approximately equal to the desired capacitance value.

The invention also includes a method of constructing an electronic circuit requiring a capacitor network having a desired breakdown voltage and capacitance value. The method comprises the steps of (1) connecting two capacitors in series, each capacitor having a preselected capacitance and breakdown voltage, (2) choosing the capacitances of the capacitors to provide a desired series capacitance value, and (3) choosing one of said two capacitors to have a breakdown voltage equal to greater than fifty percent of a desired voltage value and a capacitance approximately equal to the desired series capacitance value.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

Figure 1:
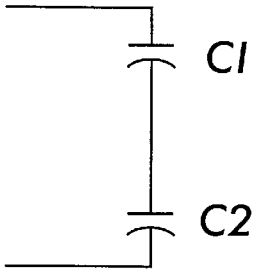
FIG.1 PRIOR ART
FIG. 1 is a simplified schematic diagram of two capacitors in series.

Referring now to the drawings, wherein like numerals indicate like elements, FIG. 1 is a simplified schematic diagram of two capacitors C1 and C2, having the same voltage rating and connected in series. Typically, in a prior art ballast circuit using two capacitors in series, each capacitor has the same voltage rating and a capacitance value of twice the desired capacitance of the series circuit. As those skilled in the art will understand, two capacitors in series have a total series capacitance $C_S$ calculated using the formula $$C_S = \frac{C_1 C_2}{C_1 + C_2}$$

Thus, if both capacitors $C_1$ and $C_2$ are equal, $$C_S = \frac{1}{2} C_1$$

Figure 2A:
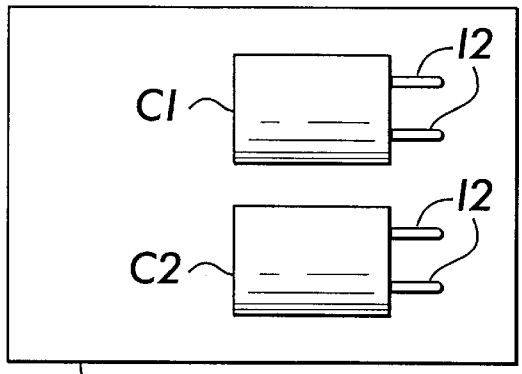
FIG.2A PRIOR ART
FIG. 2A is a top plan view, and FIG. 2B a side elevation view, of a printed circuit board having mounted thereon two capacitors of the same voltage rating and capacitance value, according to the prior art.
Figure 2B:
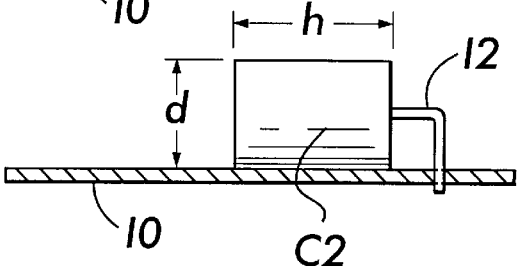
FIG.2B PRIOR ART

A typical arrangement of two capacitors connected in series on a printed circuit board according to the prior art is illustrated FIGS. 2A and 2B. In those figures, capacitors $C_1$ and $C_2$ are shown mounted on their side on printed circuit board 10. Each capacitor has two leads 12, which extend from the bottom of the capacitor. The leads 12 are bent at right angles and are inserted into corresponding openings in circuit board 10. Capacitors $C_1$ and $C_2$ may be secured to circuit board 10 by adhesive, tape, or ties, in known manner.

For a typical prior art 220 Vac, 240 Vac, or 277 Vac input line ballast, with a bus voltage of 465 Vdc, it is desired that the breakdown voltages of capacitors $C_1$ and $C_2$ add up to about 500 Vdc, to provide a safety margin over the bus voltage of 465 Vdc. It is also desired that the capacitance value of capacitors $C_1$ and $C_2$ when connected in series be about 22 $\mu$F, which is a standard capacitance value for off-the-shelf capacitors. In the prior art example illustrated in FIGS. 1, 2A, and 2B, capacitors C, and $C_2$ are identical. That is, capacitors $C_1$ and $C_2$ are both rated at 250 Vdc and have a capacitance value of 47 $\mu$F. The total voltage rating of both capacitors is 500 Vdc, and, according to formula above, the total capacitance is 23.5 $\mu$F. Capacitors having a breakdown voltage of 250 Vdc and a capacitance of 47 $\mu$F have a height h of 23 mm and a diameter d of 16 mm. When placed on their side on the printed circuit board 10, each capacitor takes up an area of 23 mm×16 mm, or 368 $mm^2$. Both capacitors together, therefore, take up 736 $mm^2$ of area on the printed circuit board. In addition, the leads 12 typically extend 5 mm or so before they are bent, requiring an additional 8 $mm^2$ per capacitor of board area to accommodate the leads. Thus, both capacitors together require 896 $mm^2$ of board area, and a total volume of 14,336 $mm^3$. As to cost, each capacitor will cost about \$0.40 in quantity. Thus, the cost of using two 250 Vdc 47 $\mu$F capacitors is about \$0.80.

With the present invention, capacitors of different voltage ratings and capacitance values are used. This saves circuit board area and total volume, and it also saves money. Instead of using two identical capacitors, that is, capacitors having identical voltage ratings and capacitance values, the invention uses capacitors which have different breakdown voltages which add up to the desired voltage value. The capacitors also have different capacitance values, which are chosen to provide a desired capacitance value when the capacitors are connected in series. At least one of the capacitors has a breakdown voltage equal to or greater than fifty percent of the desired voltage value, and preferably not less than seventy-five percent of the desired voltage. That same capacitor also has a capacitance value approximately equal to the desired capacitance value. Although most often two capacitors will be used with the invention, any number of capacitors can be used consistent with the objects of the invention. When two capacitors are used, one capacitor has a capacitance value approximately equal to the desired capacitance value, and the other capacitor has a capacitance value about ten times the capacitance value of the first capacitor.

Figure 3A:
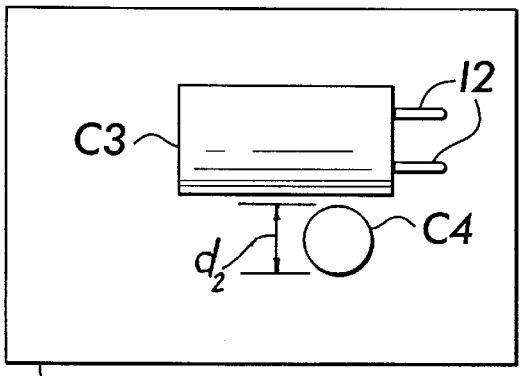
FIG. 3A is a top plan view, and FIG. 3B a side elevation view, of a printed circuit board having mounted thereon two capacitors of different voltage ratings and capacitance values, according to the invention.
Figure 4:
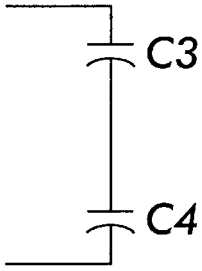
FIG. 4 is a simplified schematic diagram of the two capacitors of FIG. 3 connected in series.
Figure 3B:
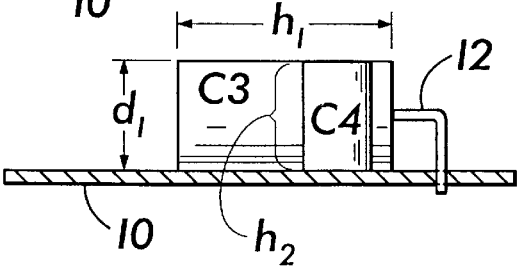

An example of the invention is illustrated in FIGS. 3A and 3B, for a 220 Vac, 240 Vac, or 277 Vac input line ballast with a bus voltage of 465 Vdc. Capacitors $C_3$ and $C_4$ are still connected in series, as shown in FIG. 4, and it is desired that the sum of the breakdown voltages of capacitors $C_3$ and $C_4$ be about 500 Vdc, which provides a margin of 35 Vdc above the bus voltage. Capacitor $C_3$ is chosen for a rated breakdown voltage of 450 Vdc, while capacitor $C_4$ is chosen for a rated breakdown voltage of only 50 Vdc. The breakdown voltage of capacitor $C_3$ is thus greater than fifty percent of the desired voltage value of 500 Vdc, and is greater than seventy-five percent of the desired voltage value. In addition, the capacitance value of capacitor $C_3$ is 22 $\mu$F while the capacitance value of capacitor $C_4$ is 220 $\mu$F. Thus, the capacitance value of capacitor $C_3$ is approximately equal to the desired capacitance value of 23.5 $\mu$F, and the capacitance value of capacitor $C_4$ is about ten times the capacitance value of capacitor $C_3$. The total voltage rating of both capacitors is series is still 500 Vdc, and the total capacitance is $$C_S = \frac{C_3 C_4}{C_3 + C_4}$$

$$C_S = \frac{220\ \mu\text{F} \times 22\ \mu\text{F}}{220\ \mu\text{F} + 22\ \mu\text{F}}$$

Even though the capacitance, at 20 $\mu$F, is somewhat less than in the prior art example (23.5 $\mu$F), the prior art example requires much more circuit board area and much more total volume. In the example according to the invention, $C_s$=20 $\mu$F capacitor $C_3$ has a height $h_1$ of 31.5 mm and a diameter $d_1$ of 16 mm. When placed on its side on a printed circuit board, as shown in FIGS. 3A and 3B, it takes up an area of 504 $mm^2$. Adding in 80 $mm^2$ for the area taken up by the leads, the total area taken up by capacitor $C_3$ is 584 $mm^2$. Capacitor $C_4$ has a diameter $d_2$ of 10 mm and a height $h_2$ of 16 mm, and when placed upright, as shown in FIGS. 3A and 3B, takes up an area of about 78.5 $mm^2$. Thus, both capacitors together take up a total of 662.5 $mm^2$. This is 233.5 $mm^2$ less than in the prior art example. With respect to volume, the total volume is 10,600 $mm^3$, or 3,736 $mm^3$ than in the prior art example.

Moreover, the cost of capacitor $C_3$ is about \$0.54 in quantity while the cost of capacitor $C_4$ is about \$0.12, for a total cost of \$0.66 for both capacitors. This represents a saving of \$0.14 per ballast just in terms of the cost of the capacitors. Additional cost savings can be realized because capacitor $C_4$ can be inserted using automated insertion equipment, thus reducing assembly costs in addition to component costs.

Of course, while the example given above uses two capacitors, more than two capacitors may be used. When more than two capacitors are connected in series, the values of the capacitors are chosen to add up to a desired capacitance value according to the general formula $$\frac{1}{C_S} = \frac{1}{C_1} + \frac{1}{C_2} + \frac{1}{C_3} + \ldots$$

At least one of the series connected capacitors should have a capacitance value approximately equal to the desired capacitance value, and a breakdown voltage equal to or greater than the desired breakdown voltage.

The present invention may be embodied in other specific forms without departing from the spirit or essential attributes thereof and, accordingly, reference should be made to the appended claims, rather than to the foregoing specification, as indicating the scope of the invention.

I claim:

1. A capacitor network comprising a plurality of capacitors in series, each capacitor having a preselected capacitance and breakdown voltage, the sum of the breakdown voltages of all the capacitors being at least equal to a desired voltage value and the capacitances of the capacitors being chosen to provide a desired capacitance value when connected in series, at least one capacitor having a breakdown voltage equal to greater than fifty percent of the desired voltage value and a capacitance approximately equal to the desired capacitance value.

2. A capacitor network as in claim 1, wherein the breakdown voltage of said at least one capacitor is not less than seventy-five percent of the desired voltage.

3. A capacitor network as in claim 1, wherein the plurality is two.

4. A capacitor network as in claim 3, wherein the breakdown voltage of one of said two capacitors is not less than seventy-five percent of the desired voltage and the capacitance of said one capacitor is approximately equal to the desired capacitance value.

5. A capacitor network as in claim 4, wherein the breakdown voltage of the other of said two capacitors is not more than twenty-five percent of the desired voltage and the capacitance of said other capacitor is about ten times the capacitance of said one capacitor.

6. In an electronic circuit, a capacitor network comprising two capacitors in series, each capacitor having a preselected capacitance and breakdown voltage, the capacitances of the capacitors being chosen to provide a desired series capacitance value, one capacitor having a breakdown voltage equal to greater than fifty percent of a desired voltage value and a capacitance approximately equal to the desired series capacitance value.

7. In an electronic circuit, a capacitor network as in claim 6, wherein the breakdown voltage of said one capacitor is not less than seventy-five percent of the desired voltage value.

8. An electronic ballast circuit having energy storage means, the energy storage means comprising a capacitor network having a plurality of capacitors in series, each capacitor having a preselected capacitance and breakdown voltage, the sum of the breakdown voltages of all the capacitors exceeding a desired voltage value related to a peak line voltage to which the ballast is expected to be subjected and the capacitances of the capacitors being chosen to provide a desired capacitance value when connected in series, at least one capacitor having a breakdown voltage equal to greater than fifty percent of the desired voltage value and a capacitance approximately equal to the desired capacitance value.

9. An electronic ballast circuit having energy storage means, the energy storage means comprising a capacitor network having two capacitors in series, each capacitor having a preselected capacitance and breakdown voltage, one capacitor having a breakdown voltage greater than seventy-five percent of a desired voltage value related to a peak line voltage to which the ballast is expected to be subjected and a capacitance approximately equal to the desired capacitance value.

10. An electronic ballast circuit having energy storage means as in claim 9, wherein the breakdown voltage of the other of said two capacitors is not more than twenty-five percent of the desired voltage and the capacitance of said other capacitor is about ten times the capacitance of said one capacitor.

11. A method of constructing an electronic circuit requiring a capacitor network having a desired breakdown voltage and capacitance value, comprising the steps of:

connecting two capacitors in series, each capacitor having a preselected capacitance and breakdown voltage, choosing the capacitances of the capacitors to provide a desired series capacitance value, and choosing one of said two capacitors to have a breakdown voltage equal to greater than fifty percent of a desired voltage value and a capacitance approximately equal to the desired series capacitance value.

12. A method of constructing an electronic circuit requiring a capacitor network having a desired breakdown voltage and capacitance value, comprising the steps of:

connecting two capacitors in series, each capacitor having a preselected capacitance and breakdown voltage, choosing one of said two capacitors to have a breakdown voltage equal to greater than seventy-five percent of a desired voltage value, and choosing the other of said two capacitors to have a breakdown voltage equal to not more than twenty-five percent of said desired voltage value and a capacitance approximately ten times the capacitance of said one of said two capacitors.

* * * * *